US011223911B2

(12) United States Patent
Langevoort et al.

(10) Patent No.: US 11,223,911 B2
(45) Date of Patent: Jan. 11, 2022

(54) INTRA EAR CANAL HEARING AID

(71) Applicants: Axign B.V., Enschede (NL); Noviosound B.V., Enschede (NL)

(72) Inventors: Jeroen Langevoort, Enschede (NL); Arthur Perry Berkhoff, Doetinchem (NL); Arnoldus Johannes Maria Baltussen, Oosterbeek (NL); Reinier van 'T Hooft, Westervoort (NL); David George Bradford, Kilmarnock (GB)

(73) Assignees: AXIGN B.V., Enschede (NL); NOVIOSOUND B.V., Enschede (NL)

( * ) Notice: Subject to any disclaimer, the term of this patent is extended or adjusted under 35 U.S.C. 154(b) by 39 days.

(21) Appl. No.: 16/499,104

(22) PCT Filed: Mar. 30, 2018

(86) PCT No.: PCT/NL2018/050201
§ 371 (c)(1),
(2) Date: Sep. 27, 2019

(87) PCT Pub. No.: WO2018/182418
PCT Pub. Date: Oct. 4, 2018

(65) Prior Publication Data

US 2021/0092532 A1 Mar. 25, 2021

(30) Foreign Application Priority Data

Mar. 30, 2017 (NL) ..... 2018617

(51) Int. Cl.
*H04R 25/00* (2006.01)

(52) U.S. Cl.
CPC ..... *H04R 25/453* (2013.01); *H04R 25/405* (2013.01); *H04R 25/505* (2013.01);
(Continued)

(58) Field of Classification Search
CPC .. H04R 25/453; H04R 25/609; H04R 25/405; H04R 25/604; H04R 2225/023; H04R 25/505
(Continued)

(56) References Cited

U.S. PATENT DOCUMENTS 10,659,028 B2 * 5/2020 Schinkel ..... H04R 1/005
2005/0052304 A1 3/2005 Trotter et al.
(Continued)

FOREIGN PATENT DOCUMENTS

DE 102012102504 9/2012
EP 2469888 6/2012
(Continued)

OTHER PUBLICATIONS

Iftekharuddin, Khan M, "Butterfly interconnection network: design of multiplier, flip-flop, and shift register", Applied Optics, vol. 33, No. 8, 1994, 1457-1462.

*Primary Examiner* — Alexander Krzystan
*Assistant Examiner* — Julie X Dang
(74) *Attorney, Agent, or Firm* — Peacock Law P.C.; Justin Muehlmeyer

(57) ABSTRACT

The present invention is in the field of an intra ear canal hearing aid, a pair of said hearing aids and use of said hearing aids. Such a hearing aid is designed to improve or support hearing. It typically relates to an electroacoustic device that is capable of transforming sound, thereby reducing noise and typically amplifying certain parts of the audio frequency spectrum. In addition such as hearing aid may improve directional perception of sound.

14 Claims, 7 Drawing Sheets

(52) U.S. Cl.
CPC ..... *H04R 25/604* (2013.01); *H04R 25/609* (2019.05); *H04R 2225/023* (2013.01)

(58) Field of Classification Search
USPC ..... 381/313
See application file for complete search history.

(56) References Cited

U.S. PATENT DOCUMENTS

| | | | | |
|---|---|---|---|---|
| 2006/0251197 | A1* | 11/2006 | Zaucha | H04S 3/008 375/350 |
| 2007/0288542 | A1* | 12/2007 | Shih | G06F 17/142 708/404 |
| 2008/0186218 | A1 | 8/2008 | Okhuri et al. | |
| 2009/0262947 | A1* | 10/2009 | Karlsson | H04S 1/00 381/17 |
| 2012/0155666 | A1 | 6/2012 | Nair | |
| 2012/0170766 | A1* | 7/2012 | Alves | G10K 11/16 381/71.11 |
| 2012/0242522 | A1* | 9/2012 | Hinz | H03H 17/04 341/143 |
| 2013/0144622 | A1* | 6/2013 | Yamada | G10L 25/00 704/248 |
| 2014/0294182 | A1* | 10/2014 | Axelsson | H04R 1/1083 381/56 |
| 2018/0075837 | A1* | 3/2018 | Maeno | G10K 15/02 |

FOREIGN PATENT DOCUMENTS

| | | | | |
|---|---|---|---|---|
| EP | 2469888 | A2 * | 6/2012 | H04R 1/1083 |
| EP | 2845314 | | 6/2016 | |
| WO | 2009/023738 | | 2/2009 | |
| WO | WO-2009023738 | A2 * | 2/2009 | H04R 25/02 |
| WO | 2013/164229 | | 11/2013 | |

* cited by examiner

| Parameter | Description | Min | Typ | Max | Units |
|---|---|---|---|---|---|
| $f_{CLK}$ | Clock frequency | 16.384 | 22.5792 | 24.576 | MHz |
| $V_{DDD}$ | Digital supply voltage | 1.65 | 1.8 | 1.95 | V |
| $V_{DDA}$ | Analog supply voltage | 1.65 | 1.8 | 1.95 | V |
| $T_J$ | Operating temperature | -40 | 55 | 125 | °C |
| **DC characteristics** | | | | | |
| $V_{REF}$ | Internal reference voltage | | 0.9 | | V |
| $V_{CM0}$ | Voltage at input nodes (virtual ground) | | 0.9 | | V |
| $V_{OS}$ | Input-equivalent offset (1-sigma) | | 150 | | µV |
| ΔG | Gain tolerance | | | Tbm ±0.5 estimate | dB |
| $I_{DDD}$ | Digital supply current of ADC | | 0.5 | | mA |
| $I_{DDA_ADC}$ | Analog supply current of ADC | | 0.5 | | mA |
| $I_{DDA_REF}$ | Analog supply current of reference | | 1 | | mA |
| **AC Characteristics** | | | | | |
| $Z_{IN}$ | Input impedance for each analog input pin | | | 2 | Ohm |
| Fs | Supported audio sample rate | 32 | | 48 | kHz |
| $I_{IN}$ | Full scale input current (equivalent to 0 dBFS) | | 50 | | µArms |
| THD | Total harmonic distortion 1kHz at -3dBFS | | | -66 | dB |
| $SFDR_{DM}$ | Spurious free dynamic range | | Tbm | | dB |
| $DR_{DM}$ | Dynamic Range | 100 | | | dB |
| PSRR | Input equivalent power supply rejection ratio | | 80 | | dB |
| SRR | Substrate rejection ratio | | Tbm | | dB |
| CM2DM | Common-mode to differential-mode conversion | | -40 | | dB |

Fig. 1

INTRA EAR CANAL HEARING AID

FIELD OF THE INVENTION

The present invention is in the field of an intra ear canal hearing aid, a pair of said hearing aids and use of said hearing aids. Such a hearing aid is designed to improve or support hearing. It typically relates to an electroacoustic device that is capable of transforming sound, thereby reducing noise and typically amplifying certain parts of the audio frequency spectrum. In addition such as hearing aid may improve directional perception of sound.

BACKGROUND OF THE INVENTION

The present invention relates in an aspect to an intra ear canal hearing aid. Hearing aids in general are known, but intra ear canal hearing aids are difficult to develop, especially in view of limited space.

In a conventional analog-to-digital converter (ADC) an analog signal is typically integrated or sampled. Therein a sampling frequency is used. Subsequently the analog signal is transferred into a digital signal, such as by quantizing, typically using a so-called multi-level quantizer. This process typically introduces error noise.

A sigma-delta (or delta-sigma) converter uses modulation for encoding analog signals into digital signals. They can be used in an analog-to-digital converter (ADC) or in a similar manner in a digital-to-analog converter (DAC). It may also be used to transfer low frequency digital signals with high resolution (bit-count) into higher frequency digital signals with lower resolution, i.e. increasing the frequency and lowering the resolution. Hence frequency and resolution can be used in a coupled manner of the two to change one of the two (e.g. frequency) and thereby the other; in terms of information the amount of information remains largely the same. In addition filters and feedback loops may be used to improve the quality of a signal obtained. In both cases a use of a lower-resolution signal typically simplifies circuit design and improves efficiency.

A typical first step in a delta-sigma converter is delta modulation. In delta modulation changes (hence delta) in a given analog signal are encoded. This results in a stream of pulses representing changes in the signal. Accuracy of modulation may be improved, such as by passing digital output of the converter through a DAC and adding (hence sigma) a resulting analog signal to the input signal, thereby reducing an error introduced by the delta-modulation.

The present invention relates in an aspect to a digital controller that may output pulse-width modulated (PWM) signals and may use feed-back of the output signal to correct for any errors. It further relates to an implementation where the feedback signal may be derived from the output of an analog to digital converter (ADC), to create a 'mixed-signal PWM controller'.

A primary application of such a controller is an audio amplifier, where the PWM signal can be used to drive a switching (class-D) amplifier. After the switching amplifier there is usually an output filter provided to remove high-frequency switching components and make a smooth out-put signal. Said output signal may be fed to a speaker. The ADC in such a controller is capable of measuring the signal directly at the speaker, i.e. after the output filter. The digital controller can subsequently be configured further e.g. to have a high loop gain to suppress non-idealities in the signal that may arise in the switching amplifier and the output filter.

It is noted that digital implementation of a loop-filter in combination with feedback after an output filter may require an ADC to digitize the output signal. This ADC preferably has a high-resolution for audio-grade signal conversion in combination with a low latency to avoid degradation of the loop stability. The ADC is preferably also tolerant towards a residue of high-frequency switching components.

Some examples of prior art programmable pulse width modulators can be found in DE 10 2012 102504 A1, US 2005/052304 A1, and WO 2013/164229 A1, whereas Iftekharuddin et al. in Applied Optics, Optical Soc. America, Washington, D.C., Vol. 33, No. 8, Mar. 10, 1994, p. 1457-1462 describes background art relating to a butterfly interconnection network. DE 10 2012 102504 A1 recites a PWM in a data-converter which uses adaptable limiters, but is otherwise considered not very flexible as it can not be adapted nor programmed as a whole, let alone individual components thereof. For in-stance the loop filters 300 are not programmable, as the coefficients have fixed values. It shows only one PWM having two outputs, which outputs are inherently dependent of one and another. It comprises a multiplexer for selecting in-puts, but it is not capable of mixing signals. US 2005/052304 A1 recites a PWM modulation circuitry with multiple paths that are nominally out of phase and are combined in an analog summer. But again, the loop-filter components are not programmable nor can their outputs be mixed. Instead, they perform a dedicated noise-shaping function specific for this data converter. WO 2013/164229 A1 describes a class-D audio amplifier with adjustable analog loop filter, but this adjusting is done automatically between a limited number of pre-defined options, depending on the modulator frequency setting. This is very different from the fully programmable digital multi-purpose loop-filter presented here.

In the field of extra ear canal devices some prior art may be cited. EP 2 469 888 A2 recites a digital circuit arrangement for an ambient noise-reduction system which is claimed to afford a higher degree of noise reduction through the use of a low latency signal processing chain consisting of analogue-to-digital conversion, digital processing and digital-to-analogue conversion. US2012/155666 (A1) recites a noise cancellation system including a first digital microphone to detect ambient noise, a first sigma delta modulator coupled to an output of the first digital microphone, a second digital microphone located near an earpiece speaker to detect an output of the earpiece speaker, a second sigma delta modulator coupled to an output of the second digital microphone, a decimator coupled to the second sigma delta modulator, and an adaptive digital filter to adaptively adjust an output of the earpiece speaker in response to the decimator and the first sigma delta modulator so that the output of the earpiece speaker includes a desired audio and an acoustic signal to cancel some or all of the ambient noise. It is clear that such systems can not be applied in the ear canal. In addition they lacks various elements such that it is more than questionable of the technology thereof could be applied in other fields.

It is an objective of the present invention to overcome disadvantages of the prior art hearing aids, and especially electrical and audio functioning thereof, without jeopardizing functionality and advantages.

SUMMARY OF THE INVENTION

The present invention relates in a first aspect to an intra ear canal hearing aid according to claim 1.

The present hearing aid comprises a housing. Incorporated in the housing or attached to the housing are the electronic components and/or power source. The housing can be made of any suitable material, such as polymers, plastics, reinforced material, etc. The housing comprises at least one input opening (e.g. 1-25) for receiving and at least one output opening (e.g. 1-25) for transmitting audio-signals, typically a few (2-10) openings. The input is typically upstream from the output. In an alternative, or in combination, the opening may also be a closed surface capable of generating or receiving sound waves, such as a membrane or the like, or a MEMS. For receiving also advanced sensors, such as fibers, could in principle be used. The openings may be in the form of an array of openings, such as an array of n*m, such as wherein n∈[1,10] and independently wherein m∈[1,10]. The number is clearly limited by the size of the ear canal and the present aid, such as by physical constraints, such as a speed of a sound wave, calculation speed, and size of an opening. When using the present hearing aid openings for receiving are positioned at an exit of the ear canal and openings for transmitting are located more towards the eardrum (tympanic membrane). An issue that has been solved with the present invention is that over the distance travelled by an audio signal (travelling at about 340 m/sec) between the opening(s) for receiving and the opening(s) for transmitting full processing of the audio signal needs to be performed and an audio signal needs to be transmitted, if relevant. A processing time mean in this context relates to a minimum time taken between updates at the output. Internally the present LLADC output can change very fast, such as every 20 ns. The present filter outputs can change very fast as well, such as every 40 ns or faster, such as the 20 ns; the present PWM output changes at a somewhat slower rate. In practice these changes may occur somewhat slower, due to sub-optimization. A processing time is therefore small, in the order of 10 μsec or less. Therefore a low latency converter is used. In view of the practical application of the present intra ear canal hearing aid the at least one opening for receiving and the at least one opening for transmitting are located at a distance of 1-10 mm, preferably 2-5 mm, such as 3-4 mm. Openings typically have a diameter of 0.1-2 mm, preferably 0.2-1 mm, such as 0.3-0.5 mm. It is preferred to use an array of 1*4 openings. With such an array feed forward and feedback calculations can be performed as well, resulting in a multistage sound processing. It has been found that the feedback loop(s) provide robustness to the system, whereas feedforward loops provide noise reduction especially at the vicinity of the ear drum. It is noted that many prior art devices can not cope appropriately with complex sounds, typically being present, such as music, voices, background, and so on. For instance, lack of calculation capacity may result in a signal with a whistle part. On the contrary, the resent device can even provide for corrections and compensations caused by reflections in the ear canal and from the ear drum.

It is also important that processing of the signals and compensating for noise and the like is best done in the ear canal itself. The present device distinguishes itself over the prior art in this respect, such as by having a much better S/N ratio, typically more than 10 dB better.

It is noted that the present solution allows partial bypass of sound waves in the ear canal. The dimensions of the present device may be chosen to allow such by-pass. Likewise a proportion of normally incident sound may be allowed to reach the eardrum via a non-blocking intra ear canal aid allowing natural hearing in addition. This could be supplemented by sound or anti-sound output from the present hearing aid.

It is noted that further factors that relate to perception of sound may easily be integrated in the present hearing aid. Examples thereof are directionality, augmentation, overlaying sound, adding sound from another source that may not be sound related, various conversion techniques, such as senses to sound, visual to sound, touch to sound (heat, radiation), and abstract conversion of information to sound. These further factors may especially be relevant to partially sighted people, hearing impaired people, and to industrial safety.

The present hearing aid comprises a power source, such as a battery, a capacitor, an electrical energy harvester, or combinations thereof. Therewith the present hearing aid can function wireless and standalone. In view of power use the present hearing aid preferably operates at a power consumption of 0.02-1 mW in use, preferably 0.05-0.5 mW, such as 0.1-0.2 mW. The power is preferably provided as 0.5-2.5V DC. The present hearing aid can preferably be switched on and off, as required. Switching, and likewise operating, is preferably performed wireless. Thereto it is preferred that a user interface is provided.

The present hearing aid comprises a clock operating at a frequency of 1-100 MHz, preferably 5-50 MHz, more preferably 10-30 MHz, even more preferably 15-25 MHz, such as 16.3-24.5 MHz, e.g. 22.6±2 MHz.

The present invention comprises a sigma-delta analog-to-digital converter (ADC). The present sigma-delta (or likewise Delta-sigma) preferably uses single bit operation; it may however also be multibit operation. An example of such a converter has a different topology compared to prior art sigma-delta ADCs, allowing for a lower latency to be obtained while maintaining or improving the signal-to-noise ratio. In a preferred example the present sigma-delta ADC comprises a forward path connected to an input of the sigma-delta ADC comprising a filtering stage and a quantization stage, the forward path having a transfer function $H_{ff}$. The converter further comprises a feedback path from an output of the forward path to the input of the sigma-delta ADC, wherein the feedback path comprises a DAC and a digital filter for converting the output of the forward path. The feedback path itself has a transfer function $H_{fb}$. the sigma-delta ADC has a stable noise transfer function NTF given by:

$$NTF(z) = \frac{1}{H_{ff}(z)H_{fb}(z)} - 1 = \frac{1}{H(z)} - 1$$

wherein H is the loop transfer function, said NTF having at least one damped zero, wherein $H_{ff}$ comprises all the undamped poles of H, and wherein $H_{fb}$ comprises at least one damped pole associated with one of said at least one damped zero. The NTF is typically expressed as a rational function comprising the ratio of a numerator polynomial and a denominator polynomial. Zeros $z_z$ of the numerator polynomial are referred to as zero's, wherein, in case $abs(z_z)<1$, the zero is called a damped zero, and an undamped zero in other cases. Similarly, zeros $z_z$ of the denominator polynomial are referred to as poles, wherein, in case $abs(z_p)<1$, the pole is called a damped pole, and an undamped pole in other cases. NTF has at least one damped zero. It is found that the latency is improved by shifting part or all of the filtering function required for noise shaping to the feedback path. An increased risk of instability, such as caused by the adding filtering in the feedback path, is counteracted by the particular choice in NTF and distribution of the poles over the forward and feedback paths. The design is such that a zero in the NTF will transform into a pole for the loop transfer function. More in particular, a damped or undamped zero in NTF will become a damped or undamped pole in H, respectively. $H_{ff}$ comprises all the undamped poles of H, if any. $H_{fb}$ comprises at least one damped pole that corresponds to one of the at least one damped zero in the NTF. It further comprises the remaining zeros and poles that are not already implemented in $H_{ff}$. The sigma-delta ADC may further comprise a correction filter connected to the output of the forward path. This correction filter preferably has a transfer function $H_{cor}$ substantially given by:

$$H_{cor} = \frac{1 + H}{H_{ff}}.$$

Preferably the correction filter has an overall wideband unity gain transfer, providing low latency at least in the band of interest. In addition the correction filter has low-pass characteristics. It is preferred that both $H_{ff}$ and $Hf_{fb}$ have low-pass characteristics, providing suitable noise shaping for low frequency signals. In an alternative $H_{ff}$ and $H_{fb}$ have band-pass or high pass characteristics providing an ADC that is adapted for other frequencies or frequency bands. Suitable noise-shaping is provided by containing the signal band of interest within the pass-band of both $H_{ff}$ and $H_{fb}$. For second order noise shaping the converter preferably comprises a first order low-pass filter or characteristics thereof in both $H_{ff}$ and $H_{fb}$, thereby reducing latency. The feedback path may comprise a finite impulse response (FIR) digital filter comprising an impulse response that approximates the impulse response associated with $H_{fb}$. Such a FIR filter can be combined with a DAC for forming a finite impulse response digital-to-analogue converter (FIRDAC). The filtering in the filtering stage can be achieved by one or more active filters such as the integrator(s). However, the filtering can additionally or alternatively be achieved with one or more passive filters. The sigma-delta ADC according to the invention allows for a relatively simple configuration of the forward path as a significant part of the required filtering is intentionally implemented in the feedback path. Such configuration could for instance comprise a single integrator in the filtering stage, which eases for example the linearity requirements.

In addition a digital control loop may be provided. Said loop comprises a forward path connected to an input of the digital control loop comprising an amplifier for amplifying a difference between a digital input signal and a second digital signal and for converting the amplified signal into an analogue output signal. It additionally may comprise a feedback path from an output of the forward path to the input of the digital control loop. The feedback path may comprise the present sigma-delta ADC for converting an analogue output signal into a second digital signal. In addition, or in combination, also a feedforward loop may be provided, as mentioned above. It is preferred that at least one of the feedback loop and feedforward loop is adaptable.

The present hearing aid comprise at least one ADC analogue input, preferably one input per ADC, at least one ADC digital output, at least one output being in electrical connection with a digital loop filter, and at least one digital loop filter in digital connection with at least one ADC, having at least one digital output, the at least one digital loop filter preferably operating in a time domain.

In addition the present invention comprises a pulse width modulating (PWM) controller. The present invention relates to a digital part that can be implemented to enable a versatile, yet still cost-effective, controller. The present programmable PWM controller provides robust loop filters with a lower Total Harmonic Distortion (THD) over the entire audio band. In an example the THD is less than 0.004% relative for input signals over the entire audio-band (20 Hz-20 kHz), as can be seen in FIG. 2*b* which relates to results of measurements. In an example the present controller can be used in a high-end audio amplifier and an active loudspeaker system. Applications also encompass an A/D converter, a power supply controller, a motor controller, and combinations thereof. It can also be used to control an active noise reduction system, as a general-purpose high-speed closed loop controller, and as a high resolution low latency data converter. An example of the present controller comprises eight channels, which are independently configurable; the configuration can easily be extended to e.g. a multiple of eight channels. Likewise controllers can be used in parallel. Also not all channels need to be used, in that case leaving some redundancy. The controller may comprise one or more ADC's, typically one ADC per channel. Typically a dynamic range of said ADCs is in the order of up to 120 dB. Sample rates of the ADC are typically in the range of several megahertz to enable low latency. The present controller provides typically volume control and soft mute modes. Some details of the present programmable mixed-signal PWM controller are provided in the description and figures. The present PWM controller comprises at least two parallel loop filters for loop-gain and signal processing, preferably at least four loop filters, more preferably at least eight loop filters (see e.g. FIG. 3). The controller typically comprises at least one setting data storage means (440) for loading, adapting and storing programmable and adaptable settings. The loop filters comprising multiple inputs and at least one, i.e. a single, output (MISO). A loop filter (20) is typically adapted to perform at least one of interpolation of the pulse code modulated (PCM) input signal, common mode control, differential mode control, audio processing, audio filtering, audio emphasizing, and LC compensation. Typically a relatively large number of inputs per loop filter may be present, such as 5-100 inputs, preferably 10-50 inputs, more preferably 20-40 inputs, such as 25 inputs. For instance in case of eight parallel loop-filters 8*3 feedback signals may be provided, a first feedback signal relating the local PWM digital signal, a second relating to the digital signal that represents a differential input voltage of the ADC and a third signal that represents a common-mode input voltage of the ADC. The $25^{th}$ signal is then the input signal that is provided by the digital interface (also referred to as PCM signal). For four parallel loop filters 4*3+1=13 signals would be present. A general formula could be N*3+1 with N the number of channels and N≥2. In systems without a local PWM feedback a similar reasoning leads to N*2+1 signals. In systems without PWM feedback and without common-mode ADC signal it would lead to N+1 signals. Each output is in electrical connection with at least one butterfly mixer (see FIG. 7). The at least one butterfly mixer is capable of mixing at least two inputs and of providing at least two mixed outputs. By mixing inputs a further improved output signal is obtained. The outputs are provided to at least two parallel pulse width modulators (PWM's), preferably 4 parallel PWM's, more preferably 8 parallel PWM's. A number of loop filters is preferably equal to a number of PWM's. The present loop filters, butterfly mixer, and PWM's are individually and independently programmable and adaptable (FIG. 3). Therewith the present PWM controller can be adapted easily, optimized for a given application, a signal to noise ratio be improved, etc. In an exemplary embodiment of the present controller the loop filter comprises at least 3, preferably at least 5, more preferably at least 7 filter stages 75 (see e.g. FIG. 5-6). Depending on boundary conditions and requirements e.g. 4-9 filter stages may be used, such as 6 and 8; more filter stages clearly attributed to costs and complexity, so in view thereof a number of filter stages is typically limited. Each stage comprises at least one of (a) an input 11 having at least one coefficient 80, (b) a feedback coefficient 82, (c) a feed forward coefficient 81, (d) an adder 71, (e) an output 24 having at least one coefficient 90, and (f) a register 85 comprising a processed signal. Said coefficient may scale (multiplies) said signal by a programmable factor. A processed signal after the adder may be re-quantized to let a word-length thereof fit in the width of the register (f). Noise-shaping can be applied by feeding back this quantization error back into the adder in subsequent samples. An exemplary embodiment uses two registers to store past quantization errors and hence applies so-called '2nd-order noise-shaping'.

Details of the present PWM can be found in Dutch Patent Application NL2016605 in the name of the same applicant, which application and contents thereof is incorporated by reference.

Therewith the ADC latency is preferably one clock cycle, hence typically within 50 nsec. This provides the audio processor with sufficient time to process audio signals. Typically feedback may be provided by the audio processor within 20 ADC clock cycles, and preferably within 10 ADC clock cycles, such as within 5 clock cycles. A purpose of the present invention is not directly to reduce latency of the ADC, but rather to provide an ADC which is so quick that within the time a sound wave travels from the input to the output of the present hearing aid, the electronics can compensate, by addressing the transducers, for (parts of) the sound wave. Such is considered very sophisticated.

The present hearing aid comprises at least one microphone capable of receiving audio-signals at a frequency of 5-25000 Hz, preferably 10-21000 Hz, such as 20-20000 Hz. The at least one microphone is preferably located close to an exit of the at least one opening for receiving, such as at a distance of 0.05-1 mm, preferably 0.1-0.2 mm. In an example the sound input may be provided without using a local microphone, but a remote microphone (e.g. at a distance of 1 mm-10 cm). Induction loop, Wi-Fi, Bluetooth or other coupled sounded sources could be used. In most cases this would be in addition to the at least one microphone.

The present hearing aid may comprise an active sound-canceller. The sound-canceller can be used to reduce the audio signal travelling through the intra ear canal by 60-120 dB, preferably 80-120 dB, over the full range of the present audio spectrum. The sound-canceller may be in the form of hardware, software, or both. It may be in the form of an algorithm. It may be fixed, adaptive, of a feedforward type, of a feedback type, and combinations thereof. The present canceller is active in a sense that cancellation is based on an audio signal received, which signal is determined in view of frequency, phase and amplitude, and subsequently an opposite audio signal may be generated to cancel the audio signal or part thereof.

The present hearing aid optionally comprises an amplifier.

The present hearing aid comprises at least one transducer capable of providing audio-signals at a frequency of 5-25000 kHz, such as a MEMS or an array of MEMS. Similar to the microphone the transducer is preferably located close to an exit of the at least one opening for receiving, such as at a distance of 0.05-1 mm, preferably 0.1-0.2 mm.

The present hearing aid provides a low latency ADC with a latency of one period (e.g. 20 ns), a low noise reference without an external component, a dynamic range of 100/120 dB over the present audio range (e.g. 20 Hz-20 kHz), supports a wide common mode range (true ground −1.8V and capacitive coupling), supports both differential and single ended input, supports different gain settings by varying input resistance values, etc. Further advantages and details are provided throughout the description.

In order to achieve good noise reduction performance in feedback control configurations a high open-loop gain is considered, with low latency in the open-loop transfer function. The open loop transfer function typically depends on various factors, such as a transfer function of the ADC, a control algorithm, the DAC, the power amplifier, the transducer, the physical propagation path from the transducer to the sensor and the sensor itself. Significant performance gains can be realized especially if all parts constituting an open loop transfer function have low latency. Furthermore, the control loop should preferably remain stable in case of changes of the acoustical conditions. In an exemplary embodiment of the present hearing aid a sensor and transducer configuration is provided in which the transducer and the sensor are collocated and in which the transducer and sensor are dual, i.e. an instantaneous product of the sensing quantity and the transducer quantity equals power. A preferred sensor-transducer combination comprises a collocated combination of a sensor providing a pressure signal, i.e. a microphone, and a transducer providing a volume velocity output. Such a configuration provides small phase shifts between transducer and sensor, even in acoustical environments which are resonating and in which the acoustical properties are not constant, and therefore allows high open-loop gains while providing stable operation. With such a configuration the range of the phase shift between the transducer and the sensor is typically between −90 and +90 degrees. Other physical combinations of sensors and actuators are also possible. It is noted that in feedforward control configurations low latency is beneficial, for example to be able to reduce a distance between reference sensors and the transducer while keeping a causal relationship between input of the reference signal and timely output of a control signal for noise reduction. A further improvement of performance and stability is obtained if the dual, collocated sensor and transducer combination is made distributed, i.e. the sensor and the transducer are extended in space in a conformal manner. In one such an embodiment the transducer has a preferred length of 0.1 to 1 times the diameter of the ear canal, preferably 0.2-0.8 times, such as 0.30.5 times, which corresponds to between approximately 0.6 mm and 8 mm for typical minimum and maximum ear canal diameters. The length of the sensor is preferably equal to the length of the transducer, while the sensor is positioned close to the transducer, in such a way that the sensor surface is parallel to the surface of the transducer. The shape of the transducer and the sensor can be tubular. Alternatively, the shape can be ring-like in case of relatively short hearing aid lengths. The transducers and sensors can also form a part of a ring or tube. The sensor surface can be approximated with a discrete array of sensors, uniformly distributed over the area of the idealized distributed sensor, and in which the discrete sensor signals can be summed in order to create a single sensor signal. As compared to point-like transducers and sensors, the distributed version has the advantage that the modification of the sound field has a wider spatial extent. The hearing aid is preferably placed at a certain minimum distance from the ear drum for reasons of comfort; dimensions of the hearing are preferably adapted as such. Therefore, with an increased region of silence of the distributed transducer and sensor, the amount of noise reduction at the ear drum effectively increases. The distributed configuration also provides less sensitivity to local phenomena and therefore leads to increased stability and robustness. The feedback controller can be supplemented with a feedforward controller which uses a part of the noise that is known and/or can be measured using a reference sensor and that can provide time-advanced information of the noise for further noise reduction.

In a second aspect the present invention relates to pair of hearing aids, each hearing aid according to the invention, preferably a pair capable of intra-pair wireless communication.

In a third aspect the present invention relates to a use of a hearing aid or a pair according to the invention, for one or more of noise cancellation, as a hearing aid, for noise reduction, for medical application, during imaging (such as MRI), for brain stimulation, for damping of sound, such as surround sound, for communication especially under noisy conditions, and for electroencephalography (EEG) measurements. It has been found that the present design is rather versatile and can be used in various settings and environments. For instance in a noisy environment, such as inside an MRI, the noise can be cancelled and wireless communication with personnel can be maintained. The present device can also be used to stimulate certain parts of the brain, and determine such as with EEG which parts of the brain are stimulated. A derivative version of AXIOM_LLSDADC is developed for EEG (electroencephalography) measurements. For such an application small signals from the brain may have to be measured on top of large disturbances that are very susceptible to resistive and capacitive loads. For this reason the AX-IOM_LLSDADC is integrated together an amplifier buffer with high impedance and small capacitive (<1 pF) inputs. FIG. 10 shows the system overview for this application.

In a fourth aspect the present invention relates to a kit of parts comprising the present hearing aid and an external low frequency aid. An external low frequency aid, typically providing sound with a frequency up to 1000 Hz, may be provided to support the present hearing aid in this low frequency domain.

In a fifth aspect the present invention relates to a sensor/transducer pair for use in an intra ear canal hearing aid, wherein the sensor is surrounding the transducer, and a distance between the sensor and the transducer d is 0.1-0.5* length l of the sensor. The sensor typically has a length l (or height) and diameter (line passing through a centre of a geometric body, from one side of the object to another side). The transducer has a similar diameter, but smaller, as the sensor is surrounding the transducer, typically 50-100% surrounding, such as 70-95%. The sensor and transducer may have the same (e.g. circular) or similar shape (e.g. circular and octagonal), or different shape. The sensor is at a distance (or likewise average distance if the shape is not the same) d of the transducer. The sensor has a length l, typically 0.1-3 mm, preferably 0.2-2 mm, such as 0.5-1.2 mm, whereas the transducer may have a similar length, or a smaller length. The sensor may be provided with openings, e.g. to allow passage of sound waves from the transducer. The transducer may be provided with attachments in order to suspend.

In view of the present hearing aid also a set of the present sensor/transducer pairs may be provided, wherein the set comprises 2-10 pairs, preferably 3-5 pairs, wherein the pairs are adjacent to one and another.

Thereby the present invention provides a solution to one or more of the above mentioned problems.

Advantages of the present description are detailed throughout the description.

DETAILED DESCRIPTION OF THE INVENTION

The present invention relates in a first aspect to a hearing aid according to claim 1.

In an exemplary embodiment of the present hearing aid the active sound canceller may comprise an audio feedback controller (18) and an audio feedforward controller (19). The at least one controller is preferably adaptable.

In an exemplary embodiment the present hearing aid may comprise at least one spaced apart transducer/sensor pair (213,214), preferably 2-10 sensor/transducer pairs, optionally wherein pairs are adjacent in a direction parallel to the intra ear canal, wherein a distance between a sensor and transducer d is preferably 0.1-0.5* length l of the sensor. The sensor is preferably surrounding the transducer.

In an exemplary embodiment of the present hearing aid the feedback controller (218) may control an input of the at least one sensor pair (213), for noise reduction, and optionally may control multiple inputs of the sensors (213), and may obtain output from the transducer (214), and optionally may control multiple outputs from the transducers (214). Such is especially achievable with a configuration such as that of the present ADC.

In an exemplary embodiment the present hearing aid the feedforward controller (219) may control the at least one transducer/sensor pair (213,214), for damping noise, wherein preferably the feedback controller may provide at least one transfer function with reduced variability to the feedforward controller.

In an exemplary embodiment the present hearing aid may comprise at least one audio sensor (215), preferably 2-5 spaced apart audio sensors (215), optionally wherein sensors are located close to a side of the hearing aid being closest to the ear canal opening. Information of such a sensor may be provided to the feedforward loop.

The sound pressure at the ear drum may be minimised by using a virtual sensor technique which predicts the sound pressure at the ear drum from sensors at different locations. This may be implemented, such as in advance, by a virtual sensor that distinguishes contributions from a primary noise source and a secondary sources on the virtual sensor location in order to maximize performance. One may regard this as a form of calibration of the present hearing aid. The virtual sensor may be formed by actual sensors and controllers. Still, variability of transfer functions is found to be rather critical for performance of virtual sensors. It is noted that variability of the transfer functions can be caused by, for example, lack of knowledge about the actual position of the device in the ear canal. The present (adaptable) feedback controller improves the transfer function. A control configuration consisting of a combination of audio feedback control and audio feedforward control is found to result in high performance, such as a noise reduction of 15-40 dB, e.g. 25 dB, compared to sound being present, even in the case of variable transfer functions. The audio feedback controller is used to add damping to the system, which is found to reduce the effect of phase shifts (less than 45°), caused by shifted resonance frequencies. Because of the low latency of the present converters that are used, high loop gains are found possible, which is found to lead to stabilisation over a wide frequency range. In addition, in order to minimise phase lag, such as to less than 15°, such as less than 10°, preferably in the open loop transfer functions, secondary sources and sensors may be arranged accordingly, for example with dual (or more) sensor/transducer pairs, preferably with minimum-phase properties over a wide frequency range (5 Hz-25 kHz). Additional robustness may be obtained by making these transducer pairs distributed in the hearing aid; a relatively flat transfer function is obtained, with minimal peaks in a frequency domain. Adding damping with such a feedback controller is also found to lead to noise reductions, but the main reason to use the feedback controller is considered to be to increase damping and to reduce variability of transfer functions; typically resonance is suppressed and phase shifts are reduced. Subsequently, feedforward control may be added to the feedback control for further noise reduction at the ear drum. The performance of the feedforward controller takes advantage of the transfer functions with reduced variability as obtained from the feedback part. Such variability is considered particularly important if a direct sensor signal at the ear drum is not available, such as with a virtual sensor. Even if a sensor signal at the ear drum is available, such as from an optical sensor sensing motion of the ear drum, then the above combination of feedback control and feedforward control still provides advantages because of the reduced variability of the transfer functions. As a result, the combination of such feedback control and feedforward control is found to achieve very high noise reductions if variability is relatively small, or it is found to tolerate very high variability of the transfer functions and still provides some noise reduction. Another advantage of the well-behaved transfer functions is that control spill over is minimal, such as <10% of the energy used, typically <5% of the energy used, as is the power to control the secondary sources. The design of a particular controller may be based on a desired trade-off between performance and control effort or stability. The overall controller is easily made adaptive by selecting the best precomputed controller from memory, depending on actual conditions. The use of virtual (and actual sensors) is found beneficial therein. An improved stability, i.e. for instances a reduction in variation of the transfer functions, and good control of power is obtained.

In an exemplary embodiment the present hearing aid may comprise a wireless transceiver, such as a Near Field Communication (NFC) or Near Field Magnetic Induction (NFMI) transceiver. Therewith communication between mutual hearing aids as well as between a hearing aid and a further wireless device, such as a smart phone or computer, can be established. In view of communication between e.g. a hearing device within a left and right ear canal respectively, a function of the pair can be optimized. In addition or as an alternative a wired transceiver may be used, but this is less preferred.

In an exemplary embodiment the present hearing aid may comprise a motion sensor. The motion sensor can be used to detect changes of the position of the ear canal or hearing aid with respect to e.g. an earth gravity field, in order to compensate for such changes.

In an exemplary embodiment the present hearing aid may comprise a pressure sensor. The pressure sensor can be used to sense the force of incoming sound.

In an exemplary embodiment the present hearing aid may comprise a positioner. The positioner can be used to put the present hearing aid in an optimal position.

In an exemplary embodiment the present hearing aid may comprise at least two microphones, such as 3-5 microphones, or an n*m array of microphones, wherein preferably $n \in [1,5]$, such as $n \in [2,4]$, and preferably $m \in [2,10]$, such as $m \in [3,7]$. Therewith a spatial distribution of sound can be determined more accurately.

In an exemplary embodiment of the present hearing aid the transducer may be selected from a HEMS, a moving coil, a permanent magnet transducer, a balanced armature transducer, and a piezo-element, preferably a MEMS. A good example of a suitable MEMS can be found in Dutch patent application NL2012419, which contents are herewith incorporated by reference. The MEMS may also comprise at least two piezoelectric elements, a cavity, and one or more of an ultrasound absorbing layer, and an ultrasound reflecting layer, a voltage source for applying a voltage to the transducer, a means for providing electrical energy, and a detector for detecting reflected ultrasound, wherein the MEMS comprises a stack of layers, the stack comprising (i) the at least two piezoelectric elements poled in a same direction, each piezoelectric element comprising a top electrode layer, a piezoelectric layer, and a bottom electrode layer, and optionally (ii) at least one dielectric layer (40) in between two piezoelectric elements. Also a series of MEMS maybe present, each MEMS individually providing an ultrasound having a frequency and a power, the series providing a multi-frequency spectrum of ultrasounds and/or powers.

In an exemplary embodiment the present hearing aid may comprise in electrical contact with the ADC at least one of an amplifier, a decimation filter, an interface, such as for a clock, and for data, a reference power source, a digital-analogue converter (DAC), a sampler, preferably a 5-50 bit sampler, wherein the DAC optionally comprises at least one digital audio input.

In an exemplary embodiment the present hearing aid may comprise at least one of a power stage, and an output filter, wherein the output filter optionally provides feedback to the at least one ADC.

In an exemplary embodiment of the present hearing aid the ADC may comprise at least one further digital output.

In an exemplary embodiment of the present PWM controller the butterfly mixer may comprise at least two stages, such as three or more stages, wherein in an initial stage outputs of two loop filters are mixed forming a mixed initial stage output, and wherein in a further stage outputs of two mixed previous stages are mixed forming a mixed further stage output (see e.g. FIG. 7-9). The mixing adds MIMO (multi-input multi-output) filtering capabilities to the system, increasing its versatility and enabling use in systems where multiple signal modes need to be controlled.

In an exemplary embodiment of the present PWM controller a pulse width modulator 40 may comprise a carrier signal 38 with an adaptable and programmable shape, phase and frequency, wherein the carrier signal is compared by the pulse width modulator 42 with the input signal 35 to create an output signal 45, wherein a carrier signal 38 of a first channel is preferably programmed to be phase synchronous and/or frequency synchronous with a carrier signal 38 of another channel, and/or wherein a carrier signal 38 is preferably disabled 41 to leave a channel "free running" without enforcing fixed-frequency PWM.

In an exemplary embodiment of the present PWM controller the PWM's 40 may provide output 45 to at least one crossbar 50, the crossbar comprising at least two outputs 55, preferably at least four outputs, a number of outputs typically being equal to the number of PWM signals 55 (see e.g. FIG. 3), wherein the crossbar is preferably adapted to permute at least two outputs 55. Advantages thereof are e.g. that at a higher level (non-chip), e.g. on a PCB, design becomes easier and has a larger degree of freedom.

In an exemplary embodiment of the present hearing aid the present PWM controller may comprise at least one adaptable and programmable linear ramp generator with feed-in coefficients 60-62. Such provides for at least one of input volume control 60, controlling crossfading typically between feedback signals 61,62, and gradual application of DC offset (see e.g. FIG. 5, elements 60-62).

In an exemplary embodiment of the present hearing aid the housing may be selected from at least one of a hollow housing, preferably a conical hollow housing, a flat housing comprising a fixing element, wherein the fixing element is preferably selected from a clamp, and a spring. It is preferred to use a housing which allows normal hearing, hence typically comprising a tube like opening, the tube extending from an input side (begin) to an output side (end).

In an exemplary embodiment of the present hearing aid the ADC may be configured to operate in at least one of differential use, single ended use, and true ground single ended use. For example a high differential range (5-120 bit, such as 10-48 bit, e.g. 24 bit resolution) can be achieved together with a wide common mode range.

The invention although described in detailed explanatory context may be best understood in conjunction with the accompanying examples and figures.

EXAMPLE

The AXIOM_LLSDADC is a high-resolution sigma-delta analog-to-digital converter. The latency is only one clock cycle (20 ns at 50 MHz), which makes the converter ideally suited for application in control loops. This is made possible by a 1-bit output bit stream that is fed back into a DAC with built-in filtering, which creates a "tracking ADC behavior" where the output accurately tracks the input signal inside the signal bandwidth. The filtering DAC also makes the system robust against jitter and other error sources typically associated with 1-bit converters. The AXIOM_LLSDADC can convert both single-ended and differential signals with high accuracy and it can convert signals with amplitudes and biasing levels well outside its own supply level, with input resistors acting as level shifters. The AXIOM_LLSDADC may be provided in two flavors: a high performance one having a 120 dB dynamic range, and a 27 mW per channel power consumption; and a low power one with a 100 dB dynamic range, and 1.8 mW per channel power consumption.

Typical specifications are given in FIG. 1.

In an output spectrum of the AXIOM_LLSDADC output bit stream a 1 kHz signal at −20 dBFS input level has been applied. The spectrum in characterized by the traditional sigma-delta noise shaping outside the band (>20 kHz) while having low noise inside the band (20 Hz-20 kHz). The dynamic range measured is 110 dB.

The low latency ADC can convert both single-ended and differential signals and it can convert signals with amplitudes and biasing levels well outside its own supply level.

Conversion resistors (Rin) may not be part of the AXIOM_LLSDADC, but may be added externally by a user. The present device having resistive inputs provides the following properties that are beneficial for many applications:

Sourcing and sinking input currents.

Input voltage range free to choose by means of resistor value.

Simultaneous conversion of differential mode and common mode signals.

High dynamic differential range on top of "any" common mode level.

FIG. 10 shows an example of a low latency ADC as feedback in a digital amplifier. The AXIOM_LLSDADC has been successfully used in a prototype version of the AXIOM_DIGAMP. This is a digital class-D audio amplifier where the feedback is taken at the speaker terminals, thus including the LC reconstruction filter. It contains the AXIOM_LLSDADC to sense the analog output directly at the speaker terminals and sophisticated digital control algorithms that enable a mixed-signal closed-loop system with high bandwidth, high loop-gain and compensation for the output filters. The application is shown in FIG. 6".

SUMMARY OF FIGURES

FIG. 1-13*a-c* show details of the present hearing aid.

DETAILED DESCRIPTION OF FIGURES

Figure 2A:
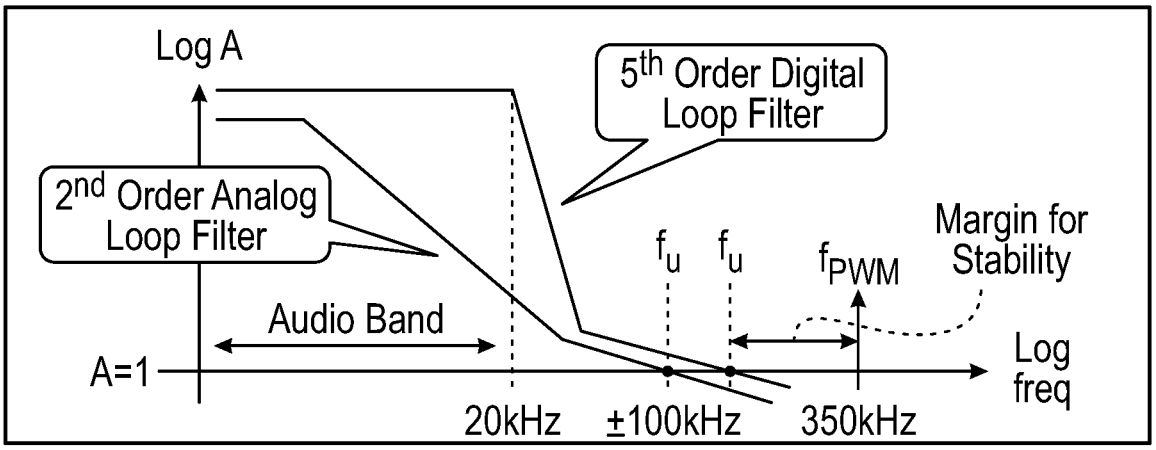

The figures are of an exemplary nature. Elements of the figures may be combined.

In the figures:

d distance between transducer and sensor
l length of transducer/sensor
10 PCM input signal
11 filter stages input
12 scaled copy of input signal
15 PWM and ADC feedback signals
16 input further channel
17 output last filter stage
20 programmable loop filter
22 adder input
23 adder output
24 stage output signals
25 output signal loop filter
30 butterfly mixer
31 (identical) butterfly element
35 output signal butterfly mixer/PWM input
38 carrier signal
40 pulse width modulator (PWM)
42 pulse width modulator
45 PWM output signal
50 crossbar
55 controller output signals
60-62 feed-in coefficients
65-66 input selector/combiner
70 first filter stage signal summation
71 normal filter stage summation
75 filter stage
76 stage input signal
77 stage output signal
78 stage feedback signal
80-82 scaling coefficients
85 storage register
90 output coefficient
100 adder
100 (digital) controller
105 butterfly input
110 input scaling (e.g. 50%)
115 input selection

125 programmable adder
130 programmable adder output
135 programmable clipper
140 clip residue
145 inverter
150 multiplexer
155 adder
160 butterfly output signal
200 intra ear canal hearing aid
211 active sound canceller
213 audio sensor/microphone
214 transducer/speaker
215 additional audio sensor
218 audio feedback controller
219 audio feedforward controller
221 input opening
222 output opening
230 pinna
231 ear canal
232 ear drum
235 ear canal
236 virtual node
237 distance
250 housing
251 battery
252 cable connection
253 centering ring
254 support
255 transducer array
257 open air pathway
258 support structure
259 tool connection point
271 output
420 clock generation unit FIG. 1 shows typical parameter settings of the present hearing aid.

FIG. 2*a* shows an example of how a 5th order digital loop-filter is able to achieve much higher loop-gain compared to a 2nd order analog filter.

Figure 2B:
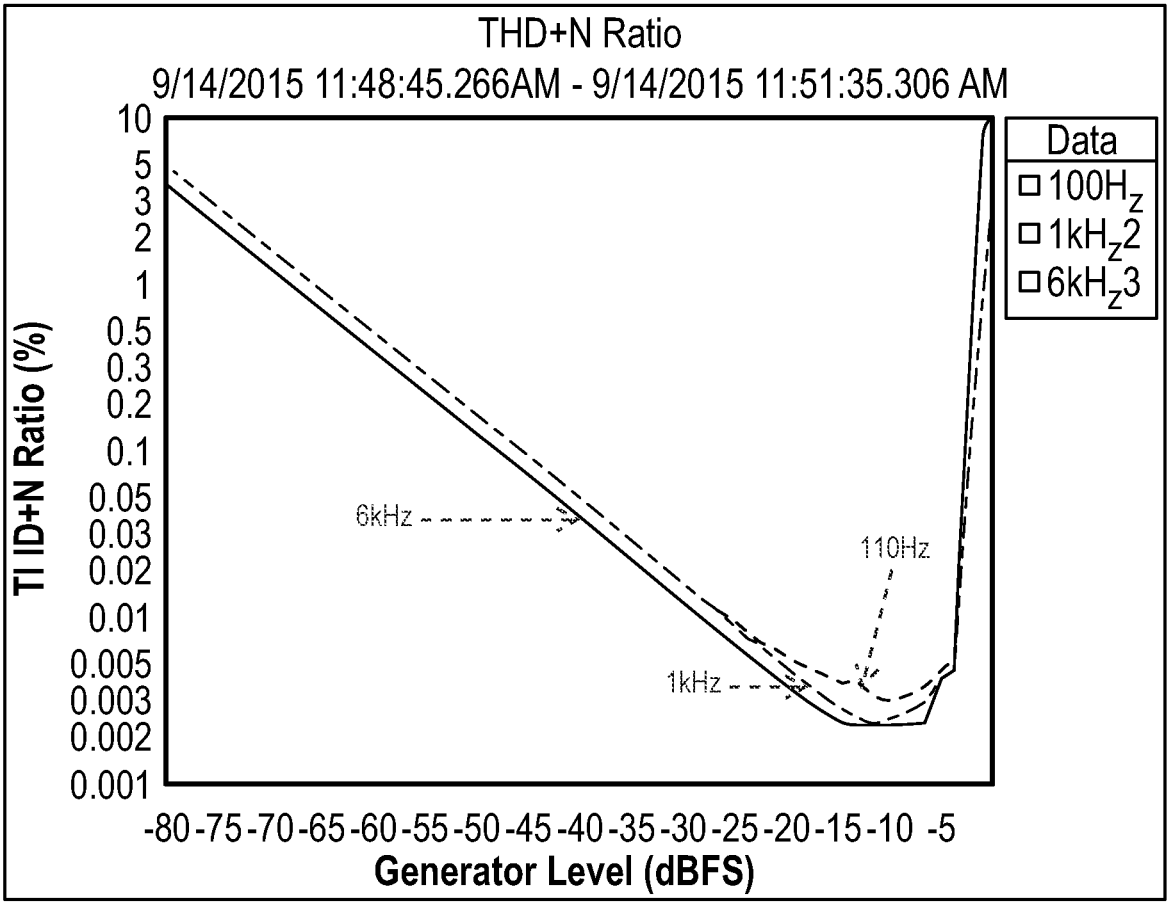

FIG. 2*b* shows measured THD+N results at the output of a 100W power amplifier that uses the present controller.

Figure 3:
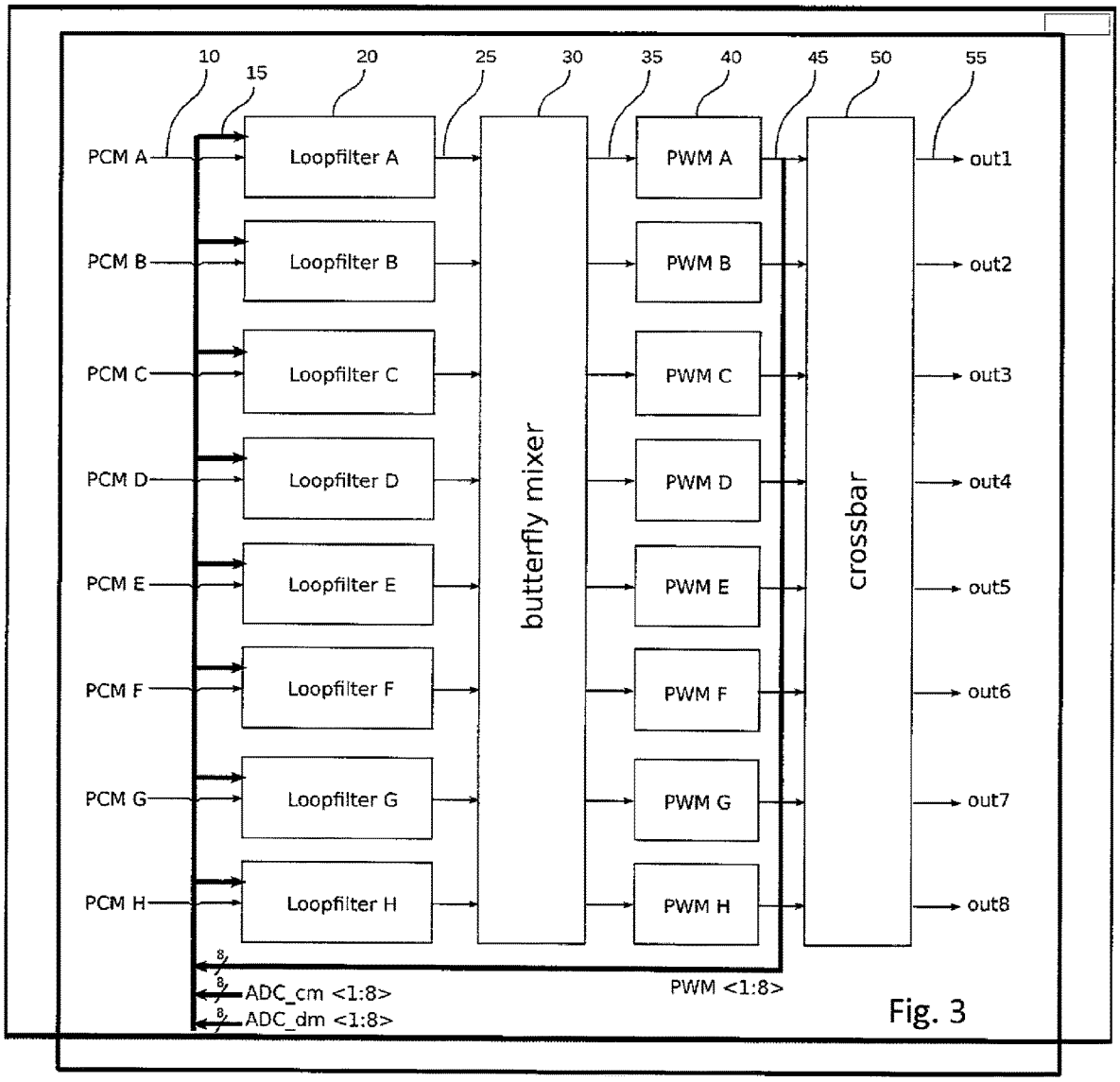

FIG. 3 shows a digital core of the programmable PWM controller. The input 10 and feedback signals 15 enter the loop-filters 20 on the left, after the signals are filtered by the programmable loop-filters they 25 are fed to the butterfly mixer 30, which can make combinations of various loop filter outputs. The resulting signal 35 is fed to the actual pulse-width modulators 40. The crossbar 50 can permute the pulse-width modulated signals 45 before they are output 55 by the system.

Figure 4:
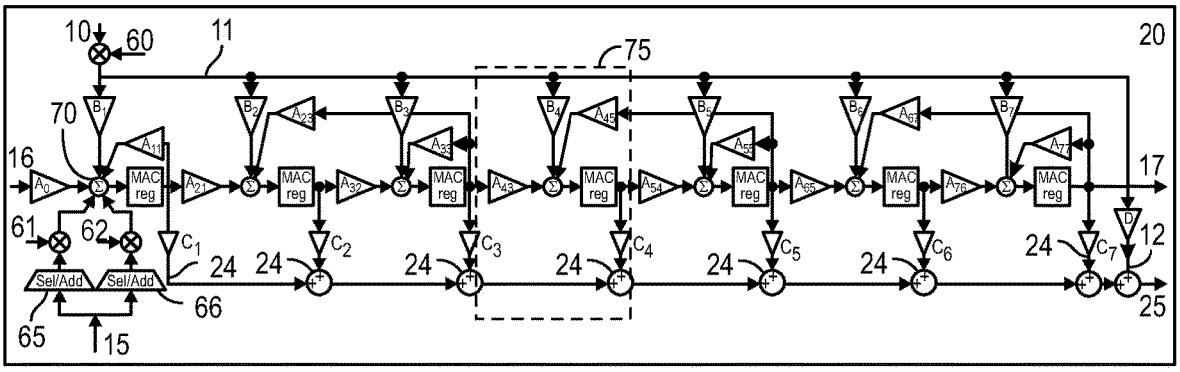

FIG. 4 shows blocks inside a single loop-filter. On the left, a programmable selection of input 10 and feedback signals 15 enter the loop-filter, where these are first processed with time-variable feed-in coefficients 60,61,62 and summed together 70. A number of cascaded loop-filter stages 75 further process the summed signal. The main output of the loop-filter 25 is formed by summing a scaled copy of the input signal 12 and a programmable selection of stage output signals 24. The output of the last filter stage 17 is an auxiliary output that can be used as input to a loop-filter in another channel 16.

Figure 5:
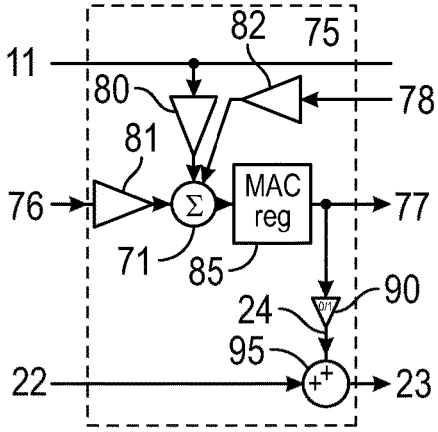

FIG. 5 shows a single loop-filter stage. It uses coefficients 80,81,82 to scale a the input that is shared for all stages 11, b the output of the previous stage 76, and c a feedback from this or a next stage 78. The scaled signals are summed 71 and fed to a storage register 85. The output of the register 77 is fed to the next stage and to an output coefficient 90.

Figure 6:
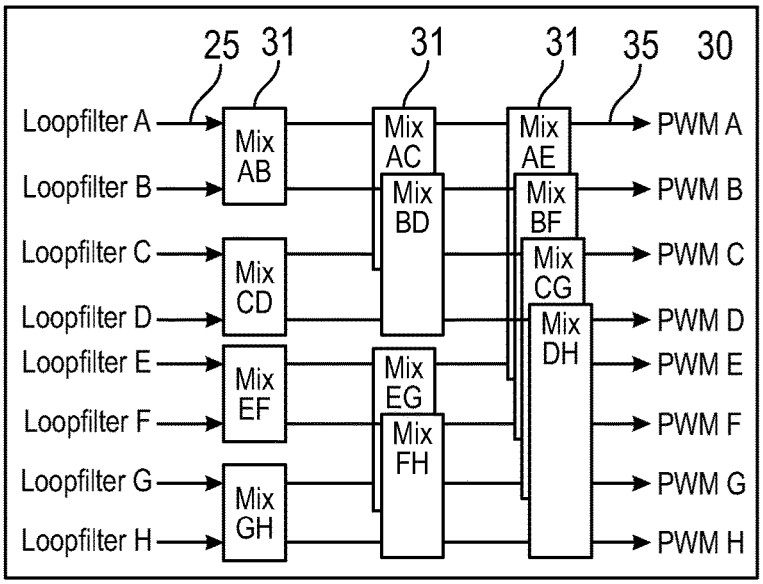

FIG. 6 shows a butterfly mixer that consists of a number of identical butterfly elements 31. The elements can be configured to mix their input signals such that a selection of loop-filter outputs 25 can be combined to create a selection of PWM inputs 35.

Figure 7:
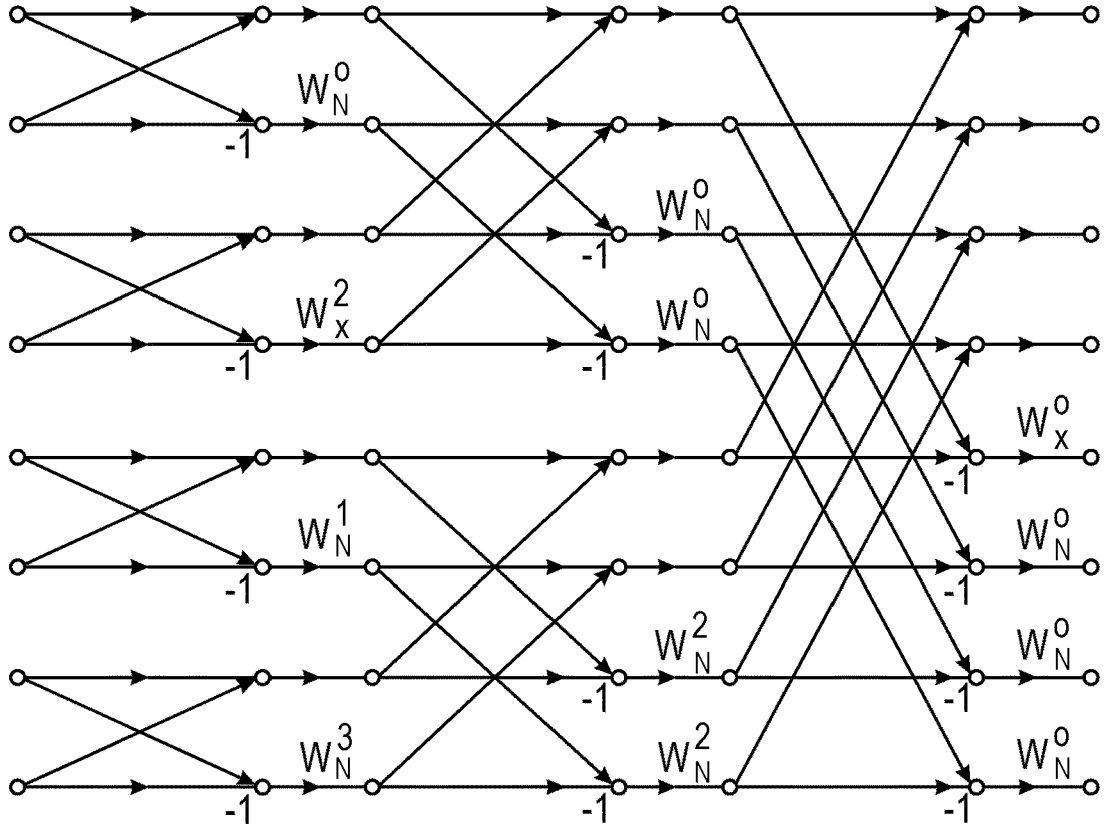

FIG. 7 illustrates the similarity of the butterfly mixer to a radix-2 decimation-in-time FFT structure, which also provides the source of the term 'butterfly element'.

Figure 8:
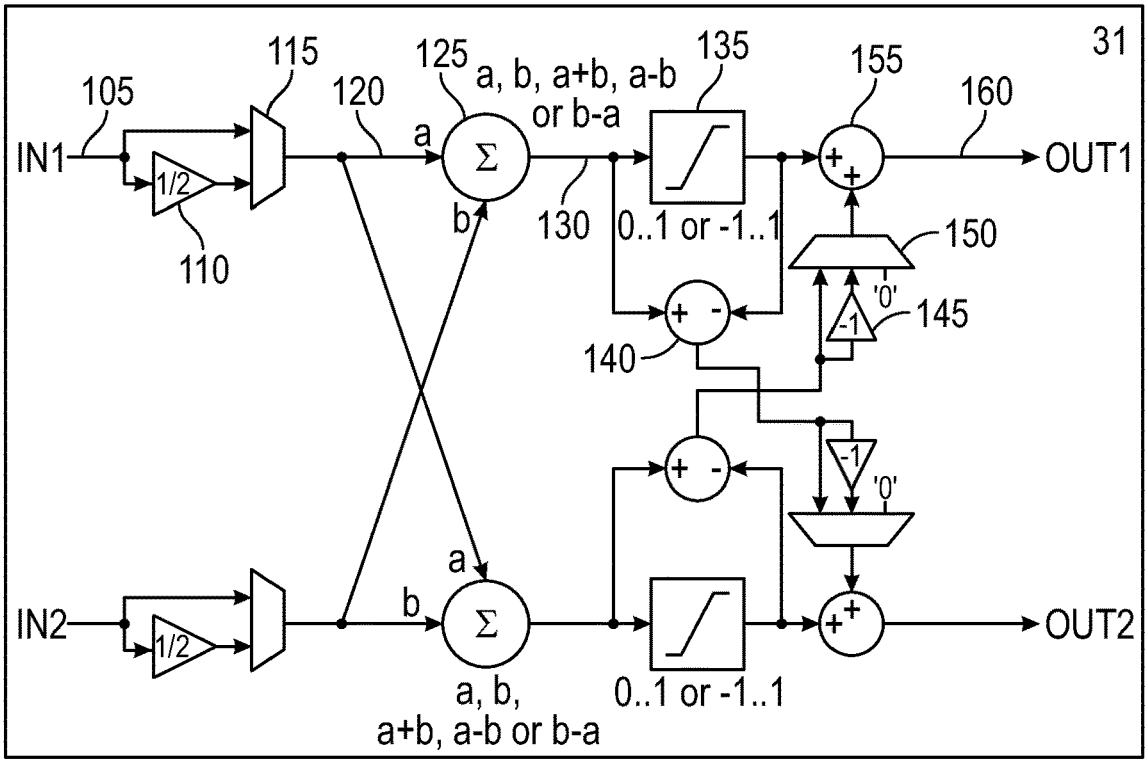

FIG. 8 shows a single butterfly element. It is a vertically symmetric structure which can scale and mix its two inputs 105 to create its two outputs 160. At the input side, either the normal input 105 or an input that is scaled by a half 110 can be selected 115. The mixing is done with the programmable adder 125 that can be configured to either pass an input, add the inputs, or subtract the inputs. The range of the mixed signals is limited with a programmable clipper 135. When the signal clips, the clip residue 140 can optionally be passed to the other side and added with the output there. This can be useful to compensate clipping errors.

Figure 9:
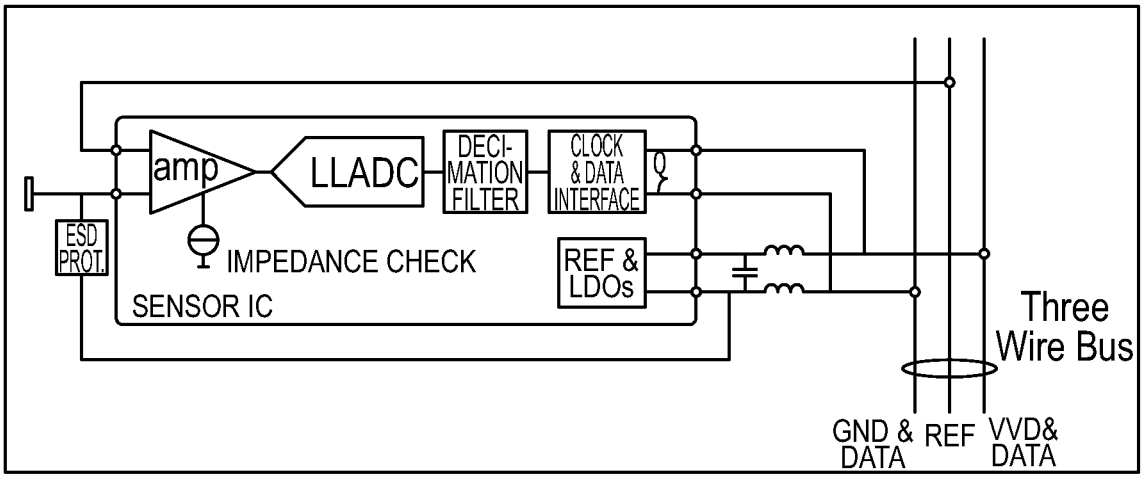

FIG. 9 shows an example of the present low latency ADC.

Figure 10:
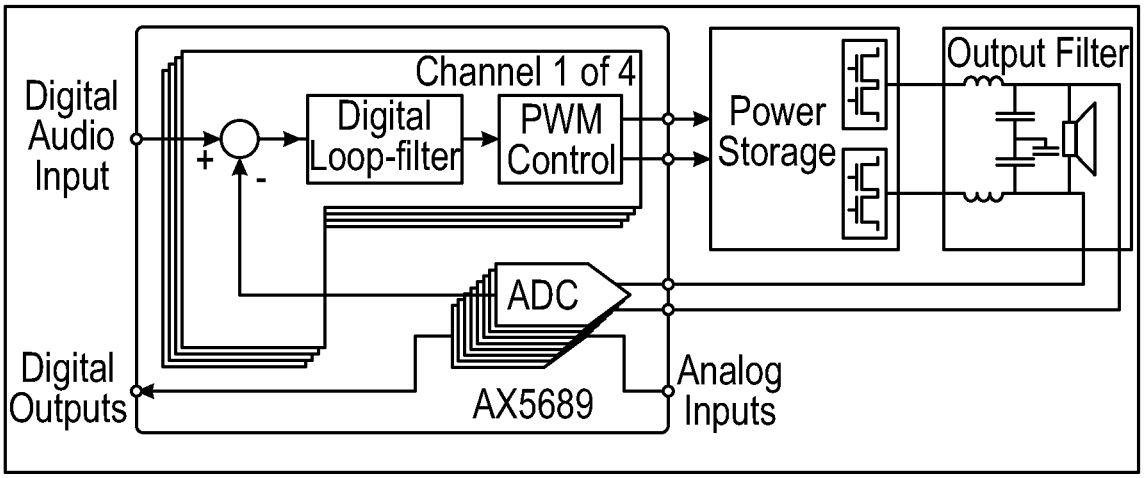

FIG. 10 shows an exemplary embodiment of the present hearing aid audio processor.

Figure 11:
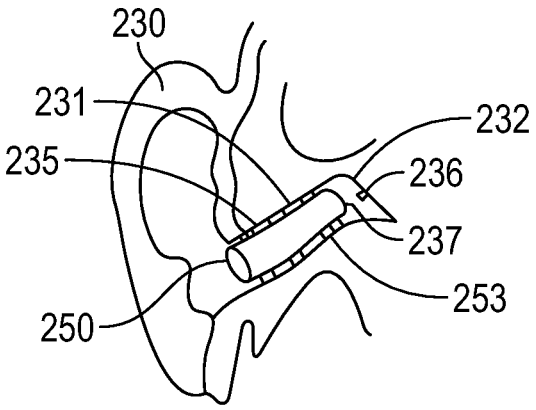

FIG. 11 shows an example of a hearing aid. Therein a pinna 230 is shown with an ear canal 231 and an ear drum 232. At least one ring 253, typically 2 to 5 rings, position the housing 250 of the device centrally within the ear canal 235. The housing is close to the eardrum typically 1-10 mm (237). The control algorithms and sensor emulate the expected signal at the virtual node 236 which is adjacent to the eardrum 232.

Figure 12:
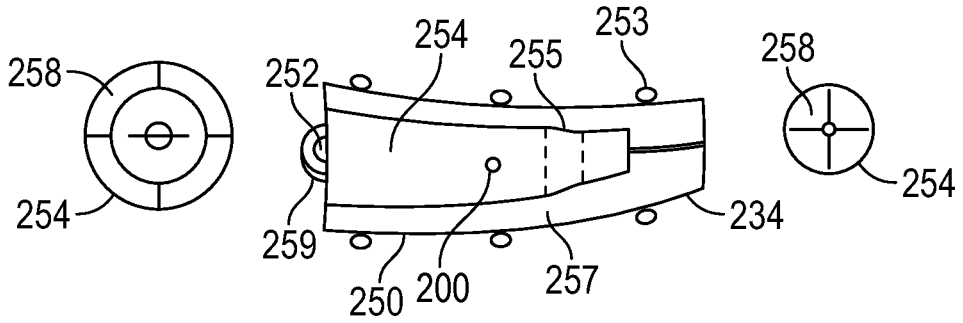

FIG. 12 shows an example of a cross section of a hearing aid within a typical housing 250. Therein electronics and batteries 251, a cable connection 252, centering rings 253, axial support 254 and an insertion and extraction point 259 is provided, an audio sensor and transducer array 255 comprising of sensors 213 and transducers 214*a, b*, an open air pathway 257, a support structure 258, and an additional microphone 213 are shown.

FIGS. 11 and 12 show generic concepts, such as a shaped cylinder 250 of approximately 7 mm diameter, some soft positioning support 253 in view of wearing comfort, and open air path 257, a deep insertion into the ear canal, a virtual measurement node 236 at or close to the eardrum, an axially located transducer and sensor (typically at least one single pair), electronics and battery 251 centrally located or in an outer shell of a cylinder, and a charge, and signal input coupling 252. Optional features are an insertion/extraction tool connection point 259, a wireless connectivity to a source, and a wireless connectivity to other wearables, such as for near field inter ear communication.

Figure 13A:
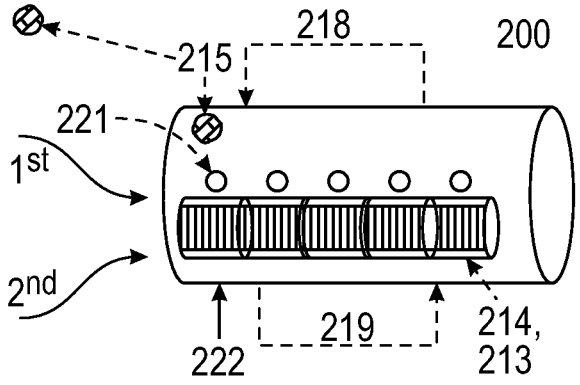

FIG. 13*a* shows schematics of the present hearing aid. It is assumed a primary ($1^{st}$) and secondary ($2^{nd}$) audio source may be present. The hearing aid 200 is provided with sensors 213, transducers 214, an audio feedback controller 218, and an audio feedforward controller 219. An input opening 221, such as for a microphone 213, and an output opening 222, such as for a transducer 214, are typically present. The working principle is described above. In addition a transducer/sensor pair may be present. Preferably 2-10 pairs are present, such as 3-5 pairs. The pairs are preferably adjacent to one and another along a central axis of the ear canal and hearing aid.

An additional audio sensor 215 may be present, either in the present hearing aid, or externally (in wireless connection), or both.

Figure 13B:
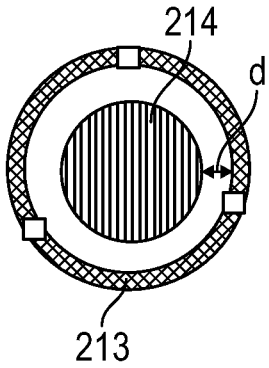
Figure 13C:
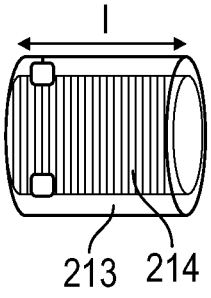

FIG. 13*b* shows an enlargement of the transducer/sensor, in top view. The transducer and sensor may have any spatial form, and cross section, such as circular, ellipsoidal, multigonal, square, triangular, hexagonal, octagonal, etc. The transducer 214 is inside the sensor/microphone 213. Between the transducer and sensor a space is provided, which may be filled, or may be air. The sensor is at a distance d from the transducer. FIG. 13*c* shows a side view of the transducer/sensor pair, the transducer not being visible from an outside normally. The pair, and in particular the sensor, has a length l. Typically l is parallel to a longer side of the hearing aid and the ear canal. FIGS. 13*b* and *c* also show optional openings in the sensor.

Figure 14:
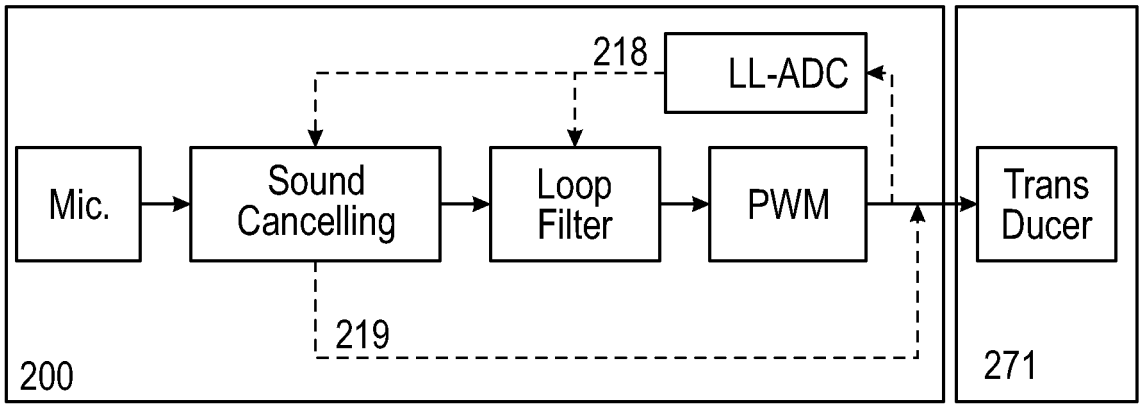
FIG. 14 shows a flow diagram.

FIG. 14 shows a sound signal coming in and being processed in the hearing aid 200. Processed sound information is then send to output 271, such as for reducing noise. Feedback 218 is provided to the hearing aid. Also feedforward 219 is provided to the output. It is noted that sound cancelling may form part of the loop filter, or not.

The invention claimed is:

1. An intra ear canal hearing aid comprising:

a housing, the housing comprising at least one input opening for receiving and at least one output opening for transmitting audio-signals, wherein the at least one opening for receiving and the at least one opening for transmitting are located at a distance of 1-10 mm, wherein the at least one input is upstream from the at least one output, a power source, and an audio processor, the audio-processor comprising a clock operating at a frequency of 1-100 MHz, at least one low-latency high resolution sigma-delta analogue-digital converter (ADC) for providing a 1-bit output stream, at least one ADC analogue input, at least one ADC digital output, at least one output being in electrical connection with a digital loop filter, at least one digital loop filter in digital connection with at least one ADC, having at least one digital output, the at least one digital loop filter preferably operating in a time domain, at least one pulse width modulating (PWM) controller for receiving digital output from the digital loop filter and providing PWM output, wherein the controller is programmable and adaptable, wherein the ADC latency in use is one clock cycle, at least one microphone capable of receiving audio-signals at a frequency of 5-25000 Hz, an active sound-canceller, for receiving input from the microphone and from the ADC, and for providing output to at least one output filter and at least one transducer, optionally an amplifier, at least one output filter, the output filter for receiving input from the sound canceller, wherein the output filter provides feed-back to the at least one ADC, and at least one transducer capable of providing audio-signals at a frequency of 5-25000 kHz.

2. The hearing aid according to claim 1, wherein the active sound canceller comprises at least one audio feedback controller and at least one audio feedforward controller, wherein at least one controller is adaptable, and wherein the feedback controller can control an input of the at least one sensor pair, for noise reduction, and can control multiple inputs of the sensors, and can obtain output from the transducer, and can control multiple outputs from the transducers, and wherein the feedforward controller controls the at least one transducer/sensor pair, for noise reduction, wherein the feedback controller provides at least one transfer function with reduced variability to the feedforward controller.

3. The hearing aid according to claim 1, comprising at least one spaced apart transducer/sensor pair, wherein a distance between a sensor and transducer d is preferably 0.1-0.5* length 1 of the sensor, and comprising at least one audio sensor, wherein sensors are located close to a side of the hearing aid being closest to the ear canal opening.

4. The hearing aid according to claim 1, further comprising at least one of a wireless transceiver, a motion sensor, a pressure sensor, and a positioner, and comprising in electrical contact with the ADC at least one of an amplifier, a decimation filter, an interface, and for data, a reference power source, a digital-analogue converter (DAC), a sampler, wherein the DAC comprises at least one digital audio input, and comprising at least one power stage.

5. The hearing aid according to claim 1, comprising at least two microphones, or an n*m array of microphones.

6. The hearing aid according to claim 1, wherein the transducer is selected from a MEMS, a moving coil, a permanent magnet transducer, a balanced armature transducer, and a piezo-element, and wherein the ADC comprises at least one further digital output.

7. The hearing aid according to claim 1, wherein the programmable pulse width modulating (PWM) controller comprises in series (i) at least two parallel loop filters for loop-gain and signal processing, each loop filter comprising multiple inputs and at least one output, wherein a loop filter is adapted to perform at least one of interpolation of the pulse code modulated (PCM) input signal, common mode control, differential mode control, audio processing, audio filtering, audio emphasizing, and LC compensation, characterized in that each single output being in electrical connection with (ii) at least one butterfly mixer, the butterfly mixer being capable of mixing at least two inputs and of providing at least two mixed outputs to (iii) at least two parallel pulse width modulators (PWM's), wherein a pulse width modulator comprises a carrier signal with an adaptable and programmable shape, phase and frequency, wherein the carrier signal is compared by the pulse width modulator with the input signal to create an output signal, wherein (iv) loop filters, butterfly mixer, and PWM's are individually and independently programmable and adaptable, wherein loop filter input is adapted to receive at least one of a local digital PWM processed output signal, and an ADC output, and comprising at least one setting data storage means for loading, adapting and storing programmable and adaptable settings.

8. The hearing aid according to claim 1, wherein in the PWM the loop filter comprises at least 3 filter stages, and wherein in the PWM the loop filter comprises at least 5 filter stages, each stage comprising at least one of (a) an input having at least one coefficient, (b) a feedback coefficient, (c) a feed forward coefficient, (d) an adder, (e) an output having at least one coefficient, and (f) a register comprising a processed signal, and wherein in the PWM the butterfly mixer comprises at least two stages, wherein in an initial stage outputs of two loop filters are mixed forming a mixed initial stage output, and wherein in a further stage outputs of two mixed previous stages are mixed forming a mixed further stage output.

9. The hearing aid according to claim 1, wherein the PWM controller comprises channels, and wherein a carrier signal of a first channel is programmed to be phase synchronous and/or frequency synchronous with a carrier signal of another channel, and/or wherein a carrier signal is disabled to leave a channel "free running" without enforcing fixed-frequency PWM, and wherein the PWM further comprises at least one analogue to digital converter (ADC) for converting an analogue signal into a digital signal, typically one ADC per loop filter.

10. The hearing aid according to claim 1, wherein the PWM's provide output to at least one crossbar, the crossbar comprising at least two outputs, a number of outputs typically being equal to the number of PWM signals, and wherein the PWM comprises at least one adaptable and programmable linear ramp generator with feed-in coefficients, for at least one of input volume control, controlling crossfading typically between feedback signals, and gradual application of DC offset, and wherein the housing is selected from at least one of a hollow housing, a flat housing comprising a fixing element, and wherein the ADC is configured to operate in at least one of differential use, single ended use, and true ground single ended use.

11. A pair of hearing aids, each hearing aid according to claim 1.

12. A kit of parts comprising a hearing aid according to claim 1 and an external low frequency aid.

13. A sensor/transducer pair for use in an intra ear canal hearing aid according to claim 1, wherein the sensor is surrounding the transducer, and a distance between the sensor and the transducer d is 0.1-0.5* length 1 of the sensor.

14. A set of sensor/transducer pairs according to claim 13, wherein the set comprises 2-10 pairs, wherein the pairs are adjacent to one and another.

* * * * *